US009517422B2

(12) United States Patent
Resh et al.

(10) Patent No.: US 9,517,422 B2
(45) Date of Patent: Dec. 13, 2016

(54) TOY TETHERING DEVICE

(71) Applicants: Alan Resh, Virginia Beach, VA (US); Sharon Resh, Viginia Beach, VA (US)

(72) Inventors: Alan Resh, Virginia Beach, VA (US); Sharon Resh, Viginia Beach, VA (US)

( * ) Notice: Subject to any disclaimer, the term of this patent is extended or adjusted under 35 U.S.C. 154(b) by 152 days.

(21) Appl. No.: 14/504,592

(22) Filed: Oct. 2, 2014

(65) Prior Publication Data

US 2016/0096117 A1 Apr. 7, 2016

(51) Int. Cl.
*A63H 33/00* (2006.01)

(52) U.S. Cl.
CPC ..... *A63H 33/006* (2013.01)

(58) Field of Classification Search
CPC ..... A63H 33/00; A63H 33/006
USPC ..... 446/227, 486, 487
See application file for complete search history.

(56) References Cited

U.S. PATENT DOCUMENTS 452,830 A * 5/1891 Bowie ..... A45F 5/02 224/220
602,215 A * 4/1898 Foster ..... A63H 33/006 446/227
2,078,022 A * 4/1937 Roemer ..... A63F 9/088 446/227
2,301,673 A * 11/1942 Allen ..... A63H 5/00 446/227
2,327,253 A * 8/1943 Eisel ..... A63H 33/006 446/227
2,432,957 A * 12/1947 Webster ..... D06F 57/00 211/113
2,490,230 A * 12/1949 Riegel ..... A63H 33/006 297/170
2,633,668 A * 4/1953 Schaefer ..... A63H 3/006 362/276
2,785,503 A * 3/1957 Schaefer ..... A63H 33/006 248/102
2,957,271 A * 10/1960 Heywood, Jr. ..... A63H 33/00 446/227
3,014,307 A * 12/1961 Dupuis ..... A63H 33/006 446/227
3,461,603 A * 8/1969 Rowell ..... A63H 5/00 446/215
3,490,172 A * 1/1970 Schwartz ..... A63H 3/006 446/298

(Continued)

FOREIGN PATENT DOCUMENTS

WO WO9829174 7/1998

*Primary Examiner* — Melba Bumgarner
*Assistant Examiner* — Joseph B Baldori

(57) ABSTRACT

A tethering assembly includes a housing that may be positioned on a support surface. A plurality of arms radiates outwardly from the housing. A plurality of cylinders is each coupled to a distal end of an associated one of the arms. A plurality of cords each extends outwardly from the distal end of an associated one of the arms and an associated one of the cylinders. A plurality of clips is each coupled to an associated one of the cords. Each of the clips may be coupled to an associated one of a plurality of toys. A plurality of retractors is each positioned within an associated one of the arms. Each of the retractors has an associated one of the cords is coupled thereto. Thus, the retractors each allow the clips to be moved between a minimum distance and a maximum distance away from the housing.

4 Claims, 4 Drawing Sheets

(56) References Cited

U.S. PATENT DOCUMENTS 3,615,092 A * 10/1971 Stubbmann ..... A63H 33/006 446/227
3,699,704 A * 10/1972 Hakim ..... A63H 3/28 428/7
4,245,486 A * 1/1981 Matsumoto ..... A44B 15/005 428/28
4,319,427 A * 3/1982 Way, Jr. ..... A63H 33/26 446/138
D289,533 S * 4/1987 Morrison ..... D21/465
4,803,953 A * 2/1989 Graves ..... A01K 15/025 119/707
5,004,633 A * 4/1991 Lovik ..... A63H 27/10 244/31
5,162,012 A * 11/1992 Blandi ..... A63H 3/28 40/455
D332,290 S * 1/1993 Altiery ..... D21/601
5,194,033 A * 3/1993 Wright ..... A63H 3/02 446/311
5,205,803 A * 4/1993 Zemitis ..... A63B 21/0552 482/121
5,339,770 A * 8/1994 Haffner ..... A01K 15/025 119/708
5,351,346 A * 10/1994 Hodges, Jr. ..... A47K 3/281 211/113
5,395,278 A * 3/1995 Dickhut ..... A63H 33/00 446/486
5,603,418 A * 2/1997 Tellefsen ..... A47G 25/14 211/113
5,702,039 A * 12/1997 Olaiz ..... A63H 33/006 224/250
D410,971 S 6/1999 Young
5,947,790 A * 9/1999 Gordon ..... A01K 15/025 119/707
6,016,926 A * 1/2000 Smith, II ..... A63H 33/006 211/118
6,174,216 B1 * 1/2001 Chianese ..... A63H 3/02 446/320
6,241,750 B1 * 6/2001 Moultrie ..... A61J 17/00 606/234
6,243,921 B1 * 6/2001 Chang ..... A61J 17/00 24/3.13
6,250,526 B1 * 6/2001 Bess ..... B60R 7/043 224/275
6,290,158 B1 * 9/2001 Huang ..... A01K 27/004 242/379
6,425,167 B1 * 7/2002 Barbarite ..... A47G 25/00 24/298
6,434,797 B1 * 8/2002 Sagman ..... A61J 17/00 24/3.1
6,464,555 B1 * 10/2002 Paduano ..... A63H 33/006 446/227
6,464,594 B1 * 10/2002 Canna ..... A63H 33/006 40/411
6,475,057 B1 * 11/2002 Norman ..... A63H 33/006 446/227
6,530,131 B1 * 3/2003 Hopkins ..... A45F 5/00 24/3.13
6,966,472 B2 * 11/2005 Szarek ..... A44C 15/005 224/250
7,020,935 B2 4/2006 Behn
7,189,136 B1 * 3/2007 Ehm ..... A63H 33/006 446/227
7,204,468 B2 * 4/2007 Kintzele ..... A47D 15/00 248/102
D573,662 S 7/2008 Behn et al.
7,661,636 B1 2/2010 Burke
7,755,483 B2 * 7/2010 Schmidt ..... A44B 15/005 242/379.2
7,806,085 B1 * 10/2010 Waddy ..... A01K 15/025 119/702
7,841,572 B2 * 11/2010 Chen ..... A63H 33/006 248/284.1
D634,372 S 3/2011 Garofalo
8,388,403 B2 * 3/2013 Seter ..... A47G 19/06 108/26
8,460,053 B2 6/2013 Fair et al.
8,480,042 B2 * 7/2013 Thompson ..... A47D 15/00 248/104
8,628,375 B2 * 1/2014 Jeong ..... A63H 33/006 446/227
2002/0124297 A1 * 9/2002 Caris ..... A61J 17/00 2/313
2006/0264148 A1 11/2006 Sejnowski et al.
2008/0313862 A1 * 12/2008 Brekke-Hutchings A63H 33/006 24/3.13
2009/0256038 A1 * 10/2009 Schaefer ..... A47G 23/0225 248/206.2
2009/0280719 A1 * 11/2009 Baltazar ..... A63H 37/00 446/486
2011/0014847 A1 * 1/2011 Fingerer ..... A63H 33/006 446/227
2011/0036745 A1 * 2/2011 Seter ..... A47G 19/06 206/565
2012/0305509 A1 12/2012 Benson
2016/0096117 A1 * 4/2016 Resh ..... A63H 33/006 446/227

* cited by examiner

TOY TETHERING DEVICE

BACKGROUND OF THE DISCLOSURE

Field of the Disclosure

The disclosure relates to tethering devices and more particularly pertains to a new tethering device for retaining a plurality of toys proximate an infant.

SUMMARY OF THE DISCLOSURE

An embodiment of the disclosure meets the needs presented above by generally comprising a housing that may be positioned on a support surface such that the housing is accessible to an infant. A plurality of arms radiates outwardly from the housing. A plurality of cylinders is each structured to be collapsible. Each of the cylinders is coupled to a distal end of an associated one of the arms with respect to the housing such that the cylinders are coextensive with the arms. Each of a plurality of cords extends outwardly from the distal end of an associated one of the arms. Each of the cords extends through an associated one of the cylinders such that each of the cords extends through an uncoupled end of the associated cylinder. Each of a plurality of clips is coupled to an exposed end of an associated one of the cords such that each of the clips may be coupled to an associated one of a plurality of toys. Each of a plurality of retractors is positioned within an associated one of the arms. Each of the cords is coupled to an associated one of the retractors. Thus, each of the retractors each allows the respective clip on the associated cord to be moved urged away from the housing. The associated cord may allow the infant to play with the associated toy. Each of the retractors selectively retracts the respective clip on the associated cord toward the housing. Thus, the cords retain the plurality of toys in close proximity to the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
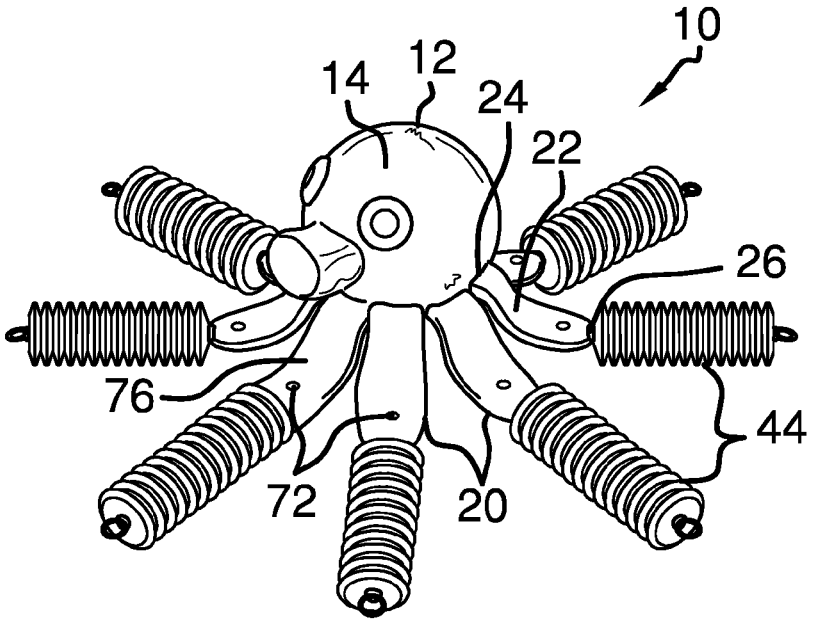
FIG. 1 is a top perspective view of a tethering assembly according to an embodiment of the disclosure.
Figure 2:
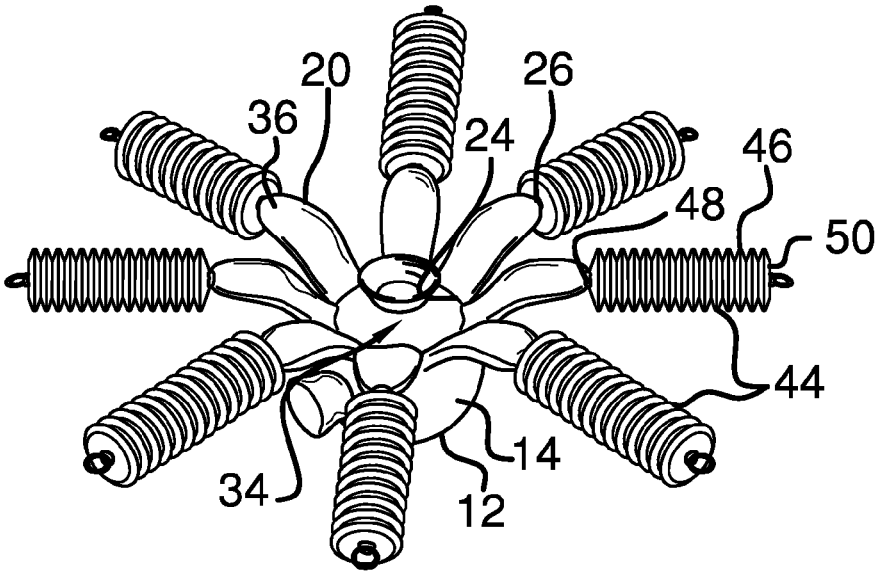
FIG. 2 is a bottom perspective view of an embodiment of the disclosure.
Figure 3:
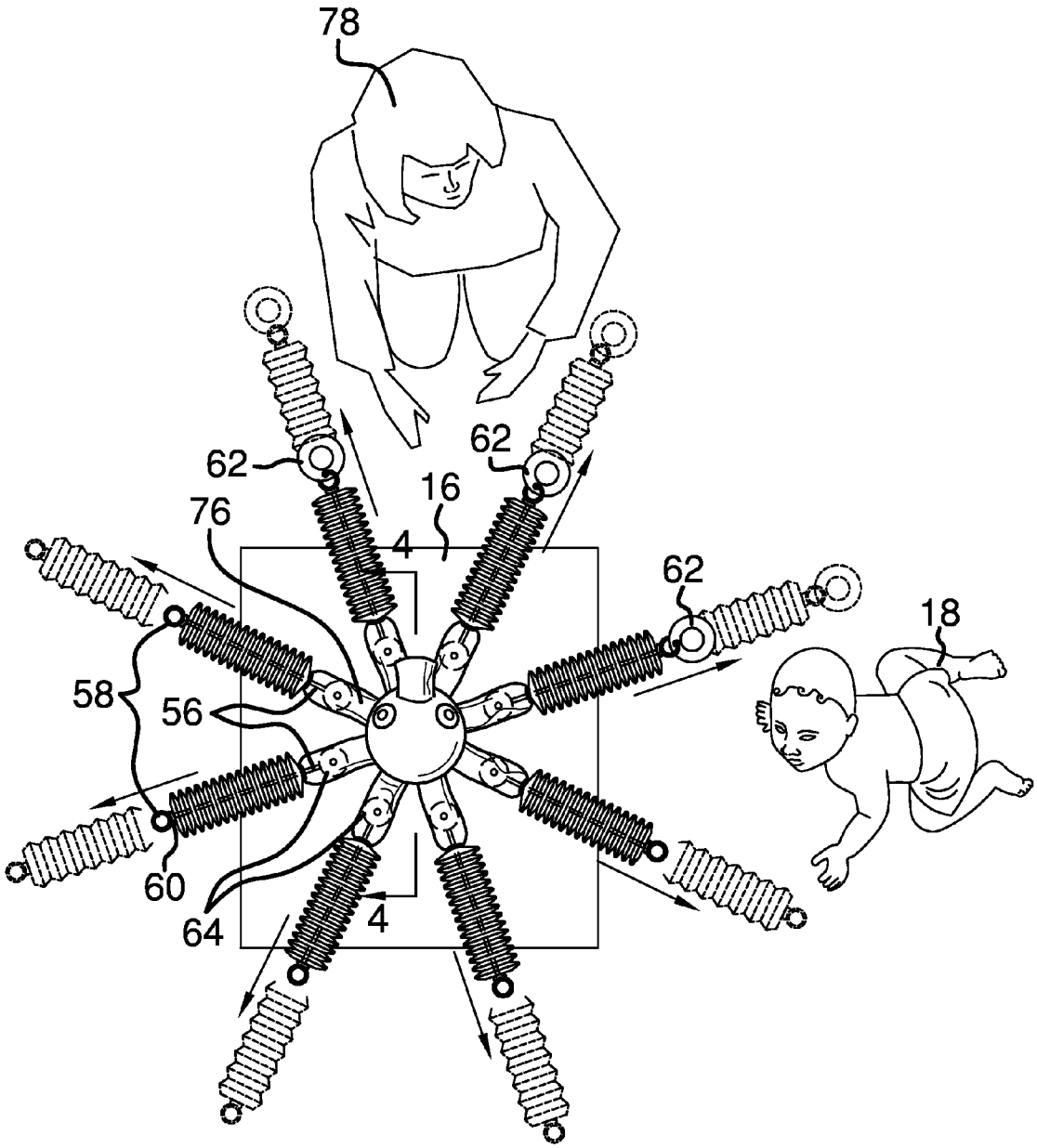
FIG. 3 is a top view of an embodiment of the disclosure.
Figure 4:
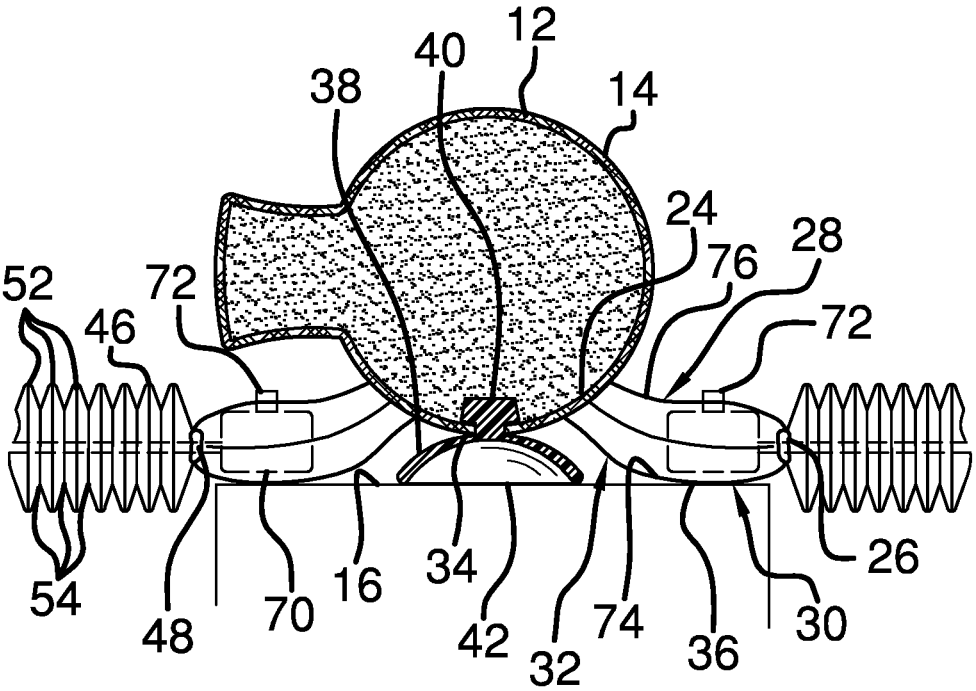
FIG. 4 is a cross sectional view taken along line 4-4 of FIG. 3 of an embodiment of the disclosure.
Figure 5:
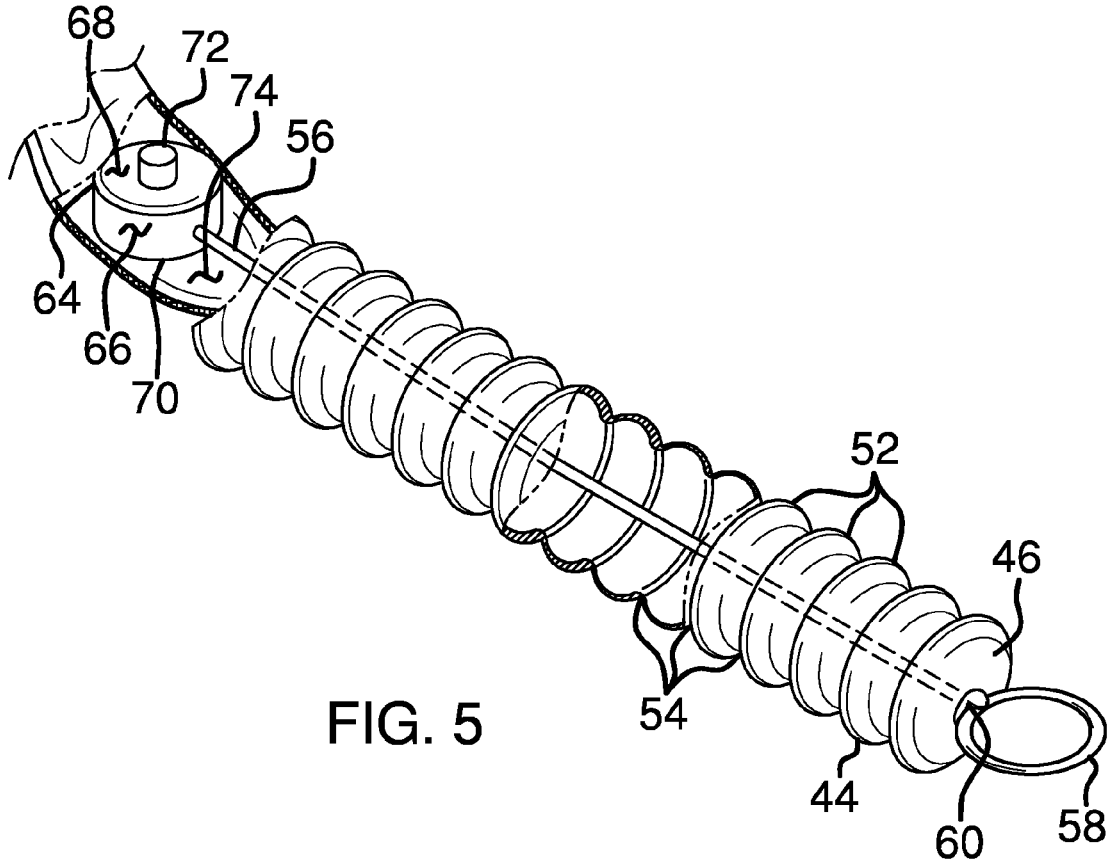
FIG. 5 is a perspective view of an embodiment of the disclosure.

With reference now to the drawings, and in particular to FIGS. 1 through 5 thereof, a new tethering device embodying the principles and concepts of an embodiment of the disclosure and generally designated by the reference numeral 10 will be described.

As best illustrated in FIGS. 1 through 5, the tethering assembly 10 generally comprises a housing 12. The housing 12 has an exterior wall 14. The exterior wall 14 of the housing 12 is curvilinear such that the housing 12 has a spherical shape. Additionally, the exterior wall 14 of the housing may be structured to resemble a cartoon character or the like. The housing 12 may be positioned on a support surface 16 such that the housing 12 is accessible to an infant 18. The support surface 16 may be a table top, a high chair tray or other similar horizontal support surface.

A plurality of arms 20 is provided. Each of the arms 20 has a respective outer wall 22 extending between a coupled end 24 of the arms 20 and a distal end 26 of the arms 20. Additionally, each of the arms 20 is substantially hollow. Each of the arms 20 has a respective bend 28 therein positioned proximate the distal end 26 of each of the arms 20 to define a first portion 30 and a second portion 32 of the arms 20. The coupled end 24 of each of the arms 20 is coupled to the exterior wall 14 of the housing 12 such that the arms 20 radiate outwardly from the housing 12. The coupled end 24 of each of the arms 20 is positioned proximate a bottom pole 34 of the housing 12. Thus, a bottommost side 36 of the outer wall 22 of each of the arms 20 associated with the first portion 30 of the arms 20 abuts the support surface 16.

A coupler 38 is provided. The coupler 38 has a top end 40 and a bottom end 42. The bottom end 42 of the coupler 38 has a diameter that is greater than a diameter of the top end 40 of the coupler 38. Moreover, the coupler 38 may be a suction cup or the like. The top end 40 of the coupler 38 is coupled to the exterior wall 14 of the housing 12 proximate the bottom pole 34 of the housing 12. Thus, the bottom end 42 of the coupler 38 engages the support surface 16 to retain the housing 12 on the support surface 16.

A plurality of cylinders 44 is provided. Each of the cylinders 44 has an outermost wall 46 extending between each of a coupled end 48 and an uncoupled end 50 of the cylinders 44. Additionally, each of the cylinders 44 is substantially hollow. The outermost wall 46 of each of the cylinders 44 is folded to define a plurality of peaks 52 and valleys 54 that are evenly spaced apart and distributed between the coupled 48 and uncoupled 50 ends of the cylinders 44. Thus, each of the cylinders 44 is compressible and expandable. The coupled end 48 of each of the cylinders 44 is coupled to the distal end 26 of an associated one of the arms 20 such that the cylinders 44 are coextensive with the first portion 30 of the arms 20.

A plurality of cords 56 each extends outwardly from the distal end 26 of an associated one of the arms 20. Each of the cords 56 extends through an associated one of the cylinders 44 such that each of the cords 56 extends through the uncoupled end 50 of the associated cylinder 44. A plurality of clips 58 is provided. Each of the clips 58 is coupled to an exposed end 60 of an associated one of the cords 56. The clips 58 each abut the uncoupled end 50 of the associated cylinder 44. Each of the clips 58 may be coupled to an associated one of a plurality of toys 62. The toys 62 may be infant toys or the like.

A plurality of retractors 64 is provided. Each of the retractors 64 has an extraneous surface 66 extending between each of an upper surface 68 and a lower surface 70 of the retractors 64. Continuing, each of the retractors 64 has a button 72 movably coupled to the upper surface 68 of the retractors 64. The lower surface 70 of each of the retractors 64 is coupled to an inside surface 74 of the bottommost side 36 of the outer wall 22 of the associated arm 20 such that each of the retractors 64 is positioned proximate the distal end 26 of the associated arm 20. The button 72 on each of the retractors 64 extends upwardly through a topmost side 76 of the outer wall 22 of the associated arm 20 such that the button 72 may be engaged by a user 78. Each of the retractors 64 has an associated one of the cords 56 coupled thereto.

In use, a selected one of the clips 58 is urged away from the housing 12 such that the associated cylinder 44 is expanded to the maximum length. An associated one of the retractors 64 with respect to the selected clip 58 retains the associated cord 56 at the selected point. Thus, the associated cord 56 allows the infant 18 to play with the associated toy 62. The associated cord 56 prevents the toy 62 from falling off of the support surface 16 if the infant 18 drops the toy 62. The associated retractor 64 retracts the selected clip 58 toward the housing 12 such that the associated cylinder 44 is compressed when the button 72 on the associated retractor 64 is engaged by the user 78. Thus, the associated cord 56 retains the associated toy 62 in close proximity to the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A tethering assembly comprising:

a housing configured to be positioned on a support surface such that said housing is accessible to an infant;

a plurality of arms radiating outwardly from said housing;

a plurality of cylinders each structured to be collapsible, each of said cylinders being coupled to a distal end of an associated one of said arms with respect to said housing such that said cylinders are coextensive with said arms;

a plurality of cords each extending outwardly from said distal end of an associated one of said arms, each of said cords extending through an associated one of said cylinders such that each of said cords extends through an uncoupled end of said associated cylinder;

a plurality of clips each coupled to an exposed end of an associated one of said cords such that each of said clips is configured to be coupled to an associated one of a plurality of toys; and a plurality of retractors each positioned within an associated one of said arms, each of said cords being coupled to an associated one of said retractors, said retractors each allowing said respective clip on said associated cord to be moved a distance away from said housing wherein said associated cord is configured to allow the infant to play with the associated toy, said retractors each selectively retracting said respective clip on said associated cord toward said housing wherein said associated cord is configured to retain the associated toy in close proximity to said housing;

said housing having an exterior wall, said exterior wall of said housing being curvilinear such that said housing has a spherical shape; each of said arms having a respective outer wall extending between a coupled end of the arms and said distal end of said arms, each of said arms being substantially hollow, each of said arms having a respective bend therein being positioned proximate said distal end of each of said arms to define a first portion and a second portion of said arms, said coupled end of each of said arms being coupled to said exterior wall of said housing, said coupled end of each of said arms being positioned proximate a bottom pole of said housing such that a bottommost side of said outer wall of each of said arms associated with said first portion of said arms abuts the support surface; and each of said cylinders having an outermost wall extending between each of a coupled end and an uncoupled end of said cylinders, each of said cylinders being substantially hollow, said outermost wall of each of said cylinders being folded to define a plurality of peaks and valleys being evenly spaced apart and distributed between said coupled and uncoupled ends of said cylinders such that each of said cylinders is compressible and expandable.

2. The assembly according to claim 1, further comprising each of said retractors having an extraneous surface extending between each of an upper surface and a lower surface of said retractors, each of said retractors having a button movably coupled to said upper surface of said retractors, said lower surface of each of said retractors being coupled to an inside surface of said bottommost side of said outer wall of said associated arm such that each of said retractors is positioned proximate said distal end of said associated arm, said button on each of said retractors extending upwardly through a topmost side of said outer wall of said associated arm such that said button is configured to be engaged by a user.

3. The assembly according to claim 2, further comprising a selected one of said clips being urged away from said housing such that said associated cylinder is expanded wherein an associated one of said retractors with respect to said selected clip retains said associated cord at the selected point, said associated retractor retracting said selected clip toward said housing such that said associated cylinder is compressed when said button on said associated retractor is engaged by the user.

4. A tethering assembly comprising:

a housing, said housing having an exterior wall, said exterior wall of said housing being curvilinear such that said housing has a spherical shape, said housing being configured to be positioned on a support surface such that said housing is accessible to an infant;

a plurality of arms, each of said arms having an outer wall extending between each of a coupled end and a distal end of said arms, each of said arms being substantially hollow, each of said arms having a respective bend therein being positioned proximate said distal end of said arms to define a first portion and a second portion of said arms, said coupled end of each of said arms being coupled to said exterior wall of said housing such that said arms radiate outwardly from said housing, said coupled end of each of said arms being positioned proximate a bottom pole of said housing such that a bottommost side of said outer wall of each of said arms associated with said first portion of said arms abuts the support surface;

a plurality of cylinders, each of said cylinders having an outermost wall extending between each of a coupled end and an uncoupled end of said cylinders, each of said cylinders being substantially hollow, said outermost wall of each of said cylinders being folded to define a plurality of peaks and valleys being evenly spaced apart and distributed between said coupled and uncoupled ends of said cylinders such that each of said cylinders is compressible and expandable, said coupled end of each of said cylinders being coupled to said distal end of an associated one of said arms such that said cylinders are coextensive with said arms;

a plurality of cords each extending outwardly from said distal end of an associated one of said arms, each of said cords extending through an associated one of said cylinders such that each of said cords extends through said uncoupled end of said associated cylinder;

a plurality of clips each coupled to an exposed end of an associated one of said cords such that each of said clips is configured to be coupled to an associated one of a plurality of toys; and a plurality of retractors, each of said retractors having an extraneous surface extending between each of an upper surface and a lower surface of said retractors, each of said retractors having a button movably coupled to said upper surface of said retractors, said lower surface of each of said retractors being coupled to an inside surface of said bottommost side of said outer wall of said associated arm such that each of said retractors is positioned proximate said distal end of said associated arm, said button on each of said retractors extending upwardly through a topmost side of said outer wall of said associated arm such that said button is configured to be engaged by a user, each of said cords being coupled to an associated one of said retractors;

a selected one of said clips being urged away from said housing such that said associated cylinder is expanded to said maximum length having an associated one of said retractors with respect to said selected clip retaining said associated cord at the selected point wherein said associated cord is configured to allow the infant to play with the associated toy; and said associated retractor retracting said selected clip toward said housing such that said associated cylinder is compressed to a minimum length when said button on said associated retractor is engaged by the user wherein said associated cord is configured to store the associated toy.

* * * * *